US005941780A

United States Patent [19]

Marier, Jr.

[11] Patent Number: 5,941,780

[45] Date of Patent: Aug. 24, 1999

[54] GOLF PUTTING PRACTICE DEVICE

[75] Inventor: Robert E. Marier, Jr., Palm City, Fla.

[73] Assignee: SwingMaker, Inc., Palm City, Fla.

[21] Appl. No.: 09/105,894

[22] Filed: Jun. 26, 1998

[51] Int. Cl.[6] ..... A63B 69/36

[52] U.S. Cl. ..... 473/227; 473/206; 473/276

[58] Field of Search ..... 473/206, 212, 473/227, 238, 276

[56] References Cited

U.S. PATENT DOCUMENTS

| | | | |
|---|---|---|---|
| 4,944,516 | 7/1990 | Bickler | 273/183 B |
| 5,152,533 | 10/1992 | Radakovich | 473/206 |
| 5,248,146 | 9/1993 | Viets et al. | 273/189 R |
| 5,259,621 | 11/1993 | Keefer | 273/187.2 |
| 5,320,354 | 6/1994 | Vasquez | 273/187.2 |
| 5,390,928 | 2/1995 | Salini | 273/187.2 |
| 5,465,971 | 11/1995 | Tischler | 273/186.2 |
| 5,470,073 | 11/1995 | Vasquez | 273/187.2 |
| 5,501,464 | 3/1996 | Dalbo | 273/187.2 |
| 5,658,204 | 8/1997 | Nappi | 473/229 |

*Primary Examiner*—George J. Marlo
*Attorney, Agent, or Firm*—Quarles & Brady

[57] ABSTRACT

A putting practice device preferably includes a body and an extension. The body preferably has a concave surface for receiving a forearm or wrist. The extension can be coplanar with the body and extends away from the body. At least one receiving hole is defined by the body or extension. A golf tee partially passes through the receiving hole and is partially inserted into a top end of a putter. The device optionally includes a flange surrounding the periphery of the body and extension and a center section surrounding the receiving holes. The flange and center section can have a thickness greater than the thickness of the body and extension.

14 Claims, 3 Drawing Sheets

GOLF PUTTING PRACTICE DEVICE

FIELD OF THE INVENTION

This invention relates to golf training equipment. More particularly, this invention relates to a new and improved device for training a golfer to maintain the proper positioning of the golfer's wrists and forearms during a putting stroke.

BACKGROUND OF THE INVENTION

Mastery of the putting stroke has been the desire of most golfers since golf's origins in Scotland many centuries ago. For most courses today, half the total strokes allotted for par are allotted for putting strokes. Thus, a good putting stroke is very important for a golfer's score during the game of golf.

Many reasons exist why golfers do not have a proper putting stroke. One of those reasons is that a golfer does not maintain the proper angular relationship between the golfer's wrists, forearms, and putter. When the proper angular relationship does not exist, the golf ball is not impacted by the face of the putter at the proper position along the face of the putter and/or in the proper direction. These conditions cause the golf ball to travel in the wrong direction and/or prevent the correct amount of momentum from being transferred from the putter to the golf ball. The result being the golf ball does not travel to its intended location.

Many devices have been introduced to help a golfer maintain the proper relationship between the golfer's wrists and forearms. One example, as shown in U.S. Pat. No. 5,259,621, involves a device having two cuffs and a body for positioning the golfer's forearm. Another example, as shown in U.S. Pat. No. 5,320,354, involves a support that can be held against the grip of a putter connected by an adjustable link to an arm pad that position's a golfer's lower leading arm. These devices are typically very bulky and are not easily stored. These devices are also quite complicated to use because of their multiple pieces and the number of adjustments needed to properly fit the device to the golfer.

SUMMARY OF THE INVENTION

It is an object of this invention to provide a putting practice device that trains the muscles of the golfer using the device to maintain desired wrist and forearm in a constant positioning throughout the stroke of the putter.

It is another object of this invention to create a putting practice device that is lightweight and thin so as to be easily stored and carried, and to minimize interference with the stroke of the putter.

It is yet another object of this invention to provide a putting practice device that can be easily made with inexpensive and lightweight materials.

It is still another object of this invention to provide a putting practice device that adjusts to various positions caused by different length putters and arms and different grips, including, for example, cross-handed grips.

Another object of this invention is to provide a putting practice device that can make use of a standard golf tee and the hole commonly found on the top of most putter grips to aid in the placement and adjustment of the putting practice device.

Yet another object of this invention is to provide a putting practice device that does not need to be removed during the stroke of the putt when the device is not being used, but instead, can swivel out of the way.

In accordance with the invention, these and other objects are accomplished by providing a putting practice device comprising a body having a preferably concave engaging surface shaped to receive a portion of a forearm or wrist of a golfer, depending on the golfer's preferred grip style. The body defines at least one receiving hole through which a pin, such as a tee, can partially pass. The pin, after being partially inserted into the receiving hole is then partially inserted into a top end of a putter. The putting practice device maintains the distance between the forearm or wrist and the top end of the putter during the stroke of a putt. By placing and maintaining the golfer's wrists and forearms in a desired position and by putting and maintaining constant, slight pressure on the concave surface by the forearm or wrist during the stroke of the putt, the golfer and the golfer's muscles are trained to keep the wrist inactive when stroking a putt.

The body preferably has a tapering extension which is preferably coplanar with the rest of the body, and the extension can be opposing the concave surface. Two or more receiving holes can be defined by the body or extension, and these holes can be collinear and/or separate from each other. A flange surrounding the periphery of the extension and body can be included with the flange being thicker than the extension and the body. When mounted on a putter shaft, the tapered extension enables the body to be rotated between a position in which the engaging surface can contact the golfer's wrist or forearm, and a position in which the tapered area faces the wrist or forearm but out of contact.

A putting practice assembly, in accordance with an additional alternative embodiment of the invention, is provided comprising a pin and a putting practice device having a body with a concave surface and an extension coplanar with the body and extending away from the body. The concave surface is shaped to receive a portion of a forearm or wrist of a golfer. The extension defines at least two collinear receiving holes. The pin, after being partially inserted into one of the receiving holes, is then partially inserted into a top end of a putter.

BRIEF DESCRIPTION OF THE DRAWINGS

There are shown in the drawings embodiments of the invention that are presently preferred, it being understood, however, that the invention is not limited to the precise arrangements and instrumentalities shown, wherein.

DETAILED DESCRIPTION OF THE PREFERRED EMBODIMENTS

Figure 2:
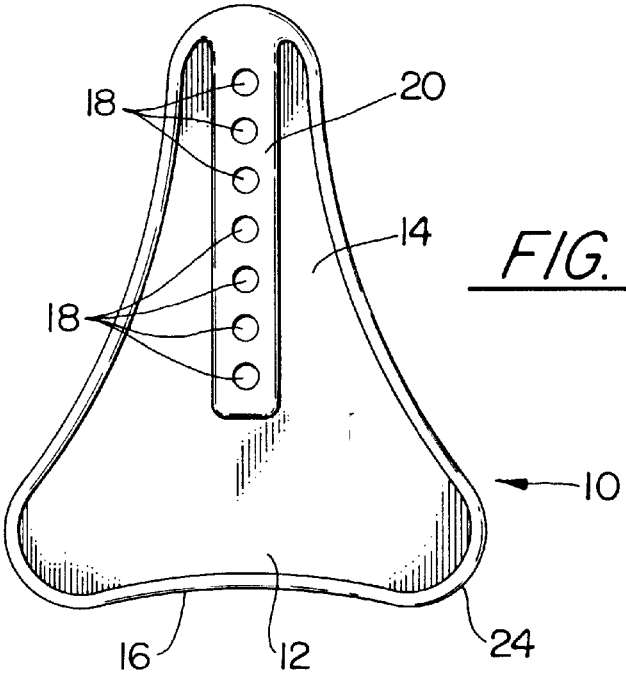
FIG. 2 is a plan view of the putting practice device shown in FIG. 1.
Figure 1:
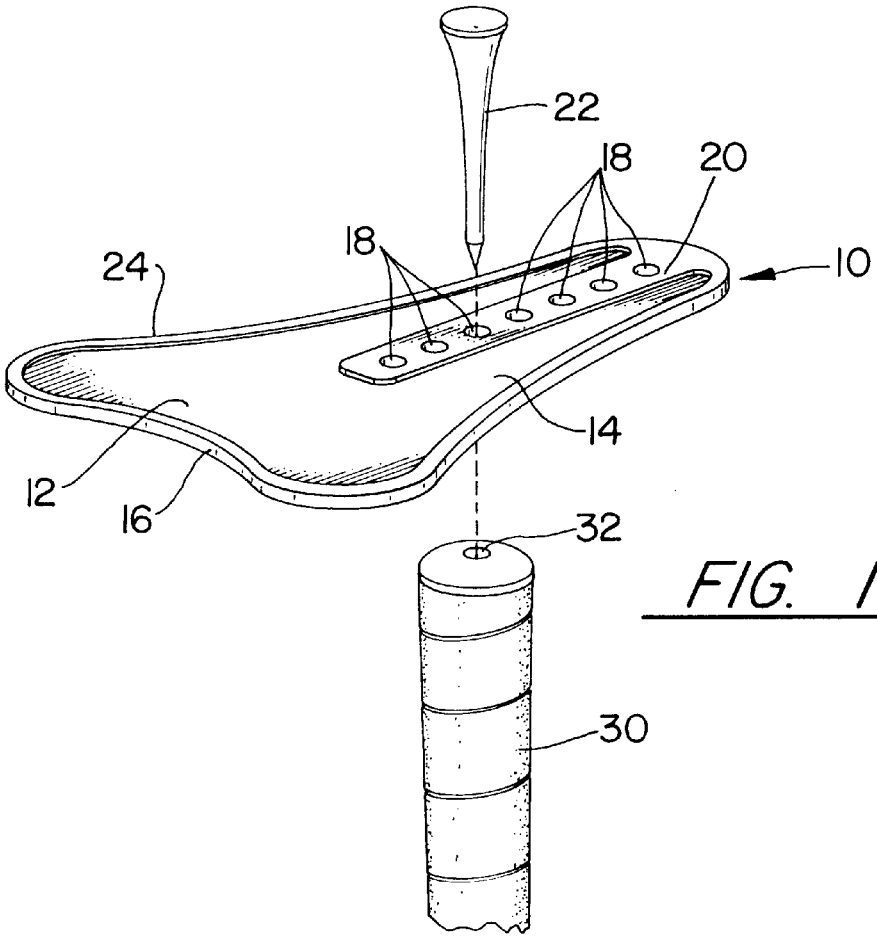
FIG. 1 is a exploded perspective view of a putting practice device and a golf tee according to the invention.
Figure 4:
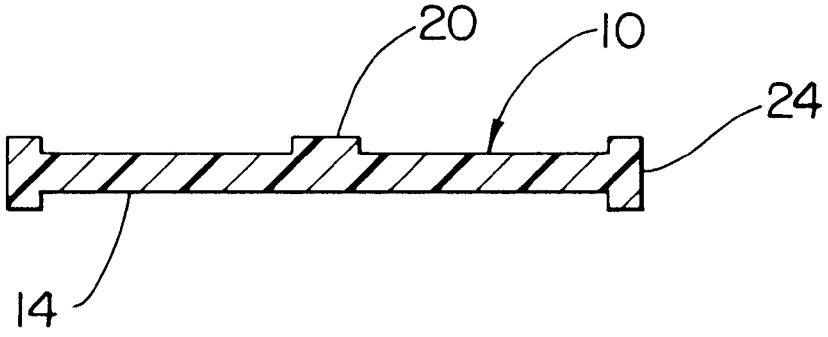
FIG. 4 is a cross-section of the putting practice device shown in FIG. 2.

FIGS. 1 and 2 illustrates a putting practice device according to the invention. The putting practice device 10 comprises a body 12 having a preferred, tapered extension 14 extending away from the body 12. The body includes a preferably concave engaging surface 16, and the extension 14 includes at least one receiving hole 18 and a center section 20 surrounding the receiving hole 18. The receiving hole 18 is dimensioned to partially accept a pin 22. Also, the putting practice device 10 optionally includes a flange 24 along the periphery of the body 12 and the extension 14. The presently preferred thickness of the body 12 and extension 14 is 1/16" and the presently preferred thickness of the flange 24 and center section is 3/16" (see FIG. 4).

Figure 3:
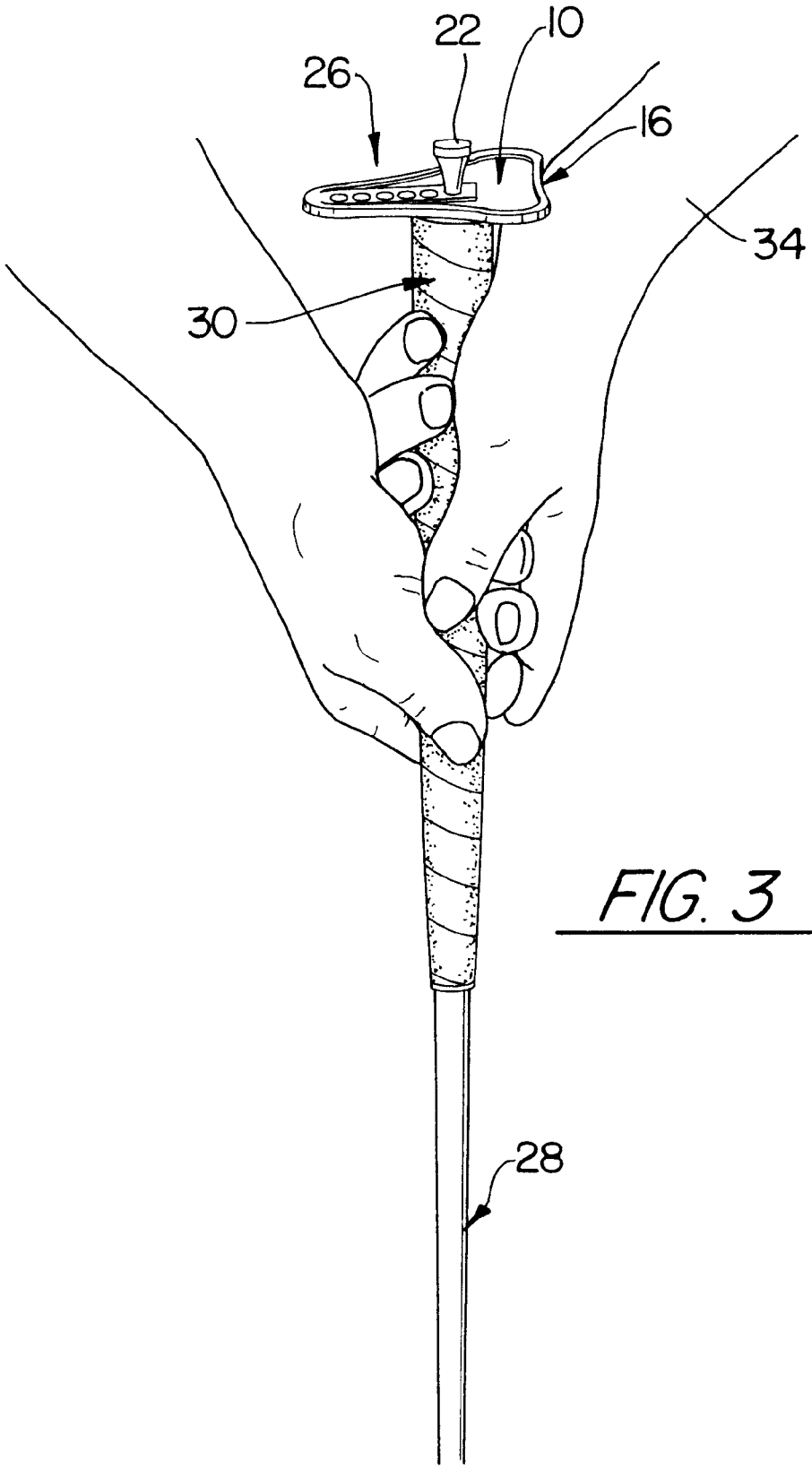
FIG. 3 is a perspective view of the putting practice device being used with an operator and putter.

FIG. 3 illustrates a putting practice assembly 26 comprised of the putting practice device 10 and the pin 22. The putting practice assembly 26 is used to maintain a constant distance between a putter 28 and the forearm or wrist 34 of a golfer. Using the pin 22 with the putting practice device 10 also allows the putting practice device 10 to be swiveled out of the way when not in use such that the putting practice device 10 is still connected to the putter 28, but the concave surface 16 is no longer contacting the forearm or wrist 34. Once positioned in a receiving hole, the pin 22 is then partially inserted into the top end hole commonly found in the top end 30 of most putters 28. The position of the pin 22 relative to the concave surface 16 defines the distance between the top end 28 of the putter 26 and the forearm or wrist 34 of the golfer. The pin 22 is positioned in the correct receiving hole 18 such that the forearm 34 of the golfer lightly contacts the concave surface 16 when the golfer's wrists and forearms are in the desired putting position. The golfer maintains the constant, light contact during the stroke of the putt to maintain the desired position of the golfer's wrists and forearms. By continuing to practice with the device in the golfer's desired grip position, the golfer is encouraged to activate the larger muscles of the shoulders and arms that enable the golfer to maintain a constant "putting triangle," that is, a triangle defined by the shoulders and arms when the wrists are brought together at the putter grip. Maintaining a constant putting triangle throughout the putt stroke can eliminate wrist movement and associated hand action.

Besides being able to be partially pass through the receiving hole 18 and being able to be partially inserted into the top end hole of the putter 28, the pin 22 is not limited as to shape or size. The presently preferred pin 22 is a standard golf tee. Because standard golf tees 22 typically taper from a small diameter to a large diameter, a golf tee 22 will pass through the receiving hole 18 until the diameter of the golf tee 22 exceeds the diameter of the receiving hole 18. An advantage of using a golf tee as the pin 22 is that golf tees are readily available to a golfer and easily replaced if lost.

The body 12 and extension 14 are not limited to any size or shape besides being able to fit between the arms of a golfer during use of the putting practice device 10. However, the body 12 and extension 14 are preferably flat and coplanar to reduce the size of the putting practice device 10. Reduced size is preferable because a lighter putting practice device 10 will interfere less with the natural stroke of the golfer than would a heavier putting practice device 10. Also, a flat putting practice device 10 is more easily stored, for example in a pocket. The body 12 can be small, for example, about three and a half inches in length and about two and a half inches at its widest, tapering to around three quarters of an inch at its tapered end.

The receiving hole 18 is dimensioned to partially accept the pin 22. Although the putting practice device 10 can be limited to only one receiving hole 18, two or more receiving holes 18 are acceptable and preferred. With two or more receiving holes 18, the putting practice device 10 can be adjusted by placing the pin 22 in the varying receiving holes 18. This adjustment changes the distance between the top end 30 of the putter 28 and the forearm 34 of the golfer. An adjustment may be necessary for different size golfers or for golfers with different grips. Thus, by having two or more receiving holes 18, a single putting practice device 10 can accommodate different golfers.

Figure 5:
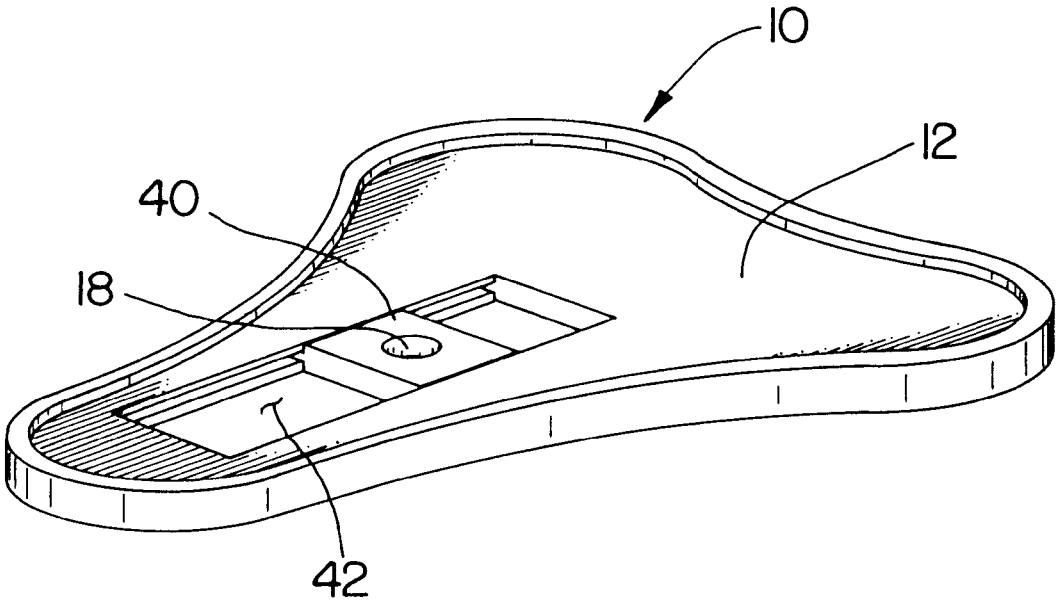
FIG. 5 is a perspective view of a second embodiment of a putting practice device according to the invention.

With multiple receiving holes 18, the receiving holes 18 need not be collinear. Also, the receiving holes 18 are not required to be completely separate. Thus, one receiving hole 18 could partially overlap another receiving hole 18. Other possibilities, as illustrated in FIG. 5, can include a single hole 18 placed on a sliding frame 40 that moves along a slot 42 formed in the body 12. However, the presently preferred putting practice device 10 includes collinear and completely separate receiving holes 18.

The invention is not limited as to the shape or length of the concave surface 16 besides requiring that the concave surface 16, during light contact with the forearm or wrist 34, does not move relative to the forearm or wrist 34 during the stroke of the putt. The engaging surface can alternatively be flat. Although the concave surface 16 can be custom fitted for a particular golfer, the concave surface is preferably sized to fit any golfer. The concave surface 16 can be located in any position on the body 12 that allows the extension 14 to be positioned over the top end 30 of the putter 28. However, the presently preferred position of the concave surface 16 is opposing the extension 14 because such position reduces the length of the body 12.

The invention is also not limited as to the material of the putting practice device 10. Examples of acceptable materials include, but not are not limited to, plastic, wood, aluminum, and steel. Changing the material also changes the weight of the putting practice device 10, and the putting practice device 10 is preferably lightweight to decrease the interference of the putting practice device 10 with the stroke of the putt. The presently preferred material for the putting practice device 10 is plastic.

Besides changing the overall weight of the device, changing the material also permits construction of the putting practice device 10 by different methods. For example, the construction methods of a steel putting practice device 10 include milling, casting, stamping, and any combination of these methods. Examples of construction methods for a wooden putting practice device 10 include milling and carving. The presently preferred construction method of the putting practice device 10 is injection molding.

The putting practice device 10 is not limited to the number of subassemblies from which the putting practice device 10 can be assembled. However, the presently preferred putting practice device 10 is single-piece construct. Advantageously, a single-piece construct requires no assembly after being injection molded. Also, a single-piece construct advantageously has no subassemblies that can be misplaced or lost.

Although preferences as to construction and use of embodiments of the invention have been set forth above with particularity, the details are considered only as examples. The scope of the invention should be determined by following claims.

What is claimed is:

1. A putting practice device, comprising:

a substantially flat body for positioning at the top of a putter shaft and having an contact surface for contacting a portion of one forearm or wrist; and, said body defining at least one receiving hole through which a pin can partially pass to secure the body to a putter shaft, whereby partially inserting a pin though said body and into a top end of a putter maintains a constant distance between said top end and said forearm or wrist portion during a stroke of said putter.

2. A putting practice device according to claim 1, said body extends to a tapered end opposite said contact surface, whereby the body can be positioned at the top of a putter to selectively either engage or not engage the portion of the golfer's wrist or forearm.

3. A putting practice device according to claim 1, wherein said contact surface is concave to receive said portion of the forearm or wrist.

4. A putting practice device according to claim 1, wherein said body defines at least two receiving holes.

5. A putting practice device according to claim 4, wherein said receiving holes are collinear.

6. A putting practice device according to claim 5, wherein said body defines separate receiving holes.

7. A putting practice device according to claim 6, further comprising a flange extending along the periphery of said body.

8. A putting practice device according to claim 7, wherein said body has a first thickness, and wherein said flange and a center section surrounding said receiving holes have a second thickness, said second thickness greater than said first thickness.

9. A putting practice assembly, comprising:

a putting practice device including a substantially flat body having a concave surface for receiving a portion of one forearm or wrist, and a tapering extension extending away from said concave surface and coplanar with said body, said extension opposing said concave surface and said extension defining at least two collinear receiving holes; and, a pin removably and partially passing through one of said receiving holes, whereby partially inserting a pin into a top end of a putter maintains a constant distance between said top end and said portion during a stroke of said putter and whereby said tapered extension enables the body to be positioned at the top of a putter to selectively either engage or not engage the portion of the golfer's wrist or forearm.

10. A putting practice device according to claim 9, wherein said extension includes a center section surrounding said receiving holes.

11. A putting practice device according to claim 10, further comprising a flange extending along the periphery of said extension and said body.

12. A putting practice device according to claim 11, wherein said extension and said body have a first thickness, and wherein said flange and said center section have a second thickness, said second thickness greater than said first thickness.

13. A putting practice device according to claim 11, wherein said pin is a golf tee.

14. A putting practice device according to claim 10, wherein said holes are collinear.

* * * * *